US006742586B2

(12) United States Patent
Lauritzen et al.

(10) Patent No.: US 6,742,586 B2
(45) Date of Patent: Jun. 1, 2004

(54) APPARATUS FOR PREVENTING EROSION OF WELLBORE COMPONENTS AND METHOD OF FABRICATING SAME

(75) Inventors: J. Eric Lauritzen, Kingwood, TX (US); Jeffery Bode, The Woodlands, TX (US); Robert Badrak, Sugarland, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/726,796

(22) Filed: Nov. 30, 2000

(65) Prior Publication Data

US 2002/0092808 A1 Jul. 18, 2002

(51) Int. Cl.[7] ..... E21B 43/08

(52) U.S. Cl. ..... 166/227; 166/230; 210/460; 210/489; 210/499

(58) Field of Search ..... 166/227, 228, 166/230; 210/170, 459, 460, 488, 489, 499

(56) References Cited

U.S. PATENT DOCUMENTS

| | | | | |
|---|---|---|---|---|
| 1,520,376 A | | 12/1924 | Verneuil | |
| 3,685,582 A | * | 8/1972 | Richardson | |
| 3,871,411 A | * | 3/1975 | Sato et al. | |
| 3,880,233 A | * | 4/1975 | Muecke et al. | |
| 4,064,938 A | | 12/1977 | Fast | 166/236 |
| 4,730,765 A | | 3/1988 | Tomlinson et al. | 228/124 |
| 4,811,790 A | | 3/1989 | Jennings, Jr. et al. | 166/278 |
| 5,150,753 A | | 9/1992 | Gaidry et al. | 166/278 |
| 5,339,895 A | * | 8/1994 | Arterbury et al. | |
| 5,829,520 A | | 11/1998 | Johnson | 166/250.01 |
| 5,855,242 A | | 1/1999 | Johnson | 166/236 |
| 6,006,829 A | | 12/1999 | Whitlock et al. | 166/228 |

FOREIGN PATENT DOCUMENTS

| | | | |
|---|---|---|---|
| EP | 0 819 831 | 1/1998 | E21B/43/08 |

OTHER PUBLICATIONS

PCT International Search Report from international Application No. PCT/GB01/04875, Dated Apr. 29, 2002.

* cited by examiner

*Primary Examiner*—Robert Popovics
(74) *Attorney, Agent, or Firm*—Moser, Patterson & Sheridan, L.L.P.

(57) ABSTRACT

An apparatus for preventing erosion of wellbore components comprises a wellscreen and a coating disposed on the wellscreen. The coating includes a metal-based coating and preferably nickel and phosphorous. The coating may also be organic-based such as phenolic resin containing ceramic or cermet. A method for fabricating an erosion and corrosion resistant wellbore component by providing the wellbore component and treating the wellbore component with erosion resistant materials. The treating step is conducted by plating the wellbore component, preferably by electroless plating. The treating step further comprises heat treatment of the wellbore component subsequent to plating. An additional step of inserting the treated wellbore component into a wellbore may also be conducted.

4 Claims, 3 Drawing Sheets

APPARATUS FOR PREVENTING EROSION OF WELLBORE COMPONENTS AND METHOD OF FABRICATING SAME

BACKGROUND OF THE INVENTION

1. Field of the Invention

The invention relates to apparatus utilized in the production of hydrocarbons. More particularly, the invention relates to an apparatus and method for preventing erosion of wellbore components utilized in wellbores during production of hydrocarbons.

2. Description of the Background Art

When a wellbore is ready for production of hydrocarbons, wellbore components such as a wellscreen are typically inserted into the wellbore on a string of production tubing. Thereafter production fluid passes through the wellscreen and is pumped to the surface through the tubing. Wellscreen typically includes a perforated inner tube and some type of wire screen (sand screen) therearound to prevent sand and other debris from entering the tubing with the production fluid. The wellscreen, when placed downhole, forms an annular area with the wellbore.

When using a wellscreen in a wellbore, the annular area surrounding the wellscreen is often filled with gravel in a gravel packing operation. FIG. 1 is a cross sectional view of a well including a wellscreen in a wellbore with a gravel pack. Gravel packing is useful for additional filtering the production fluid, establishing a uniform flow of the production fluid along the wellscreen and preventing the collapse of the adjacent formation. FIG. 1 illustrates a formation 100, a wellbore 102 proximate the formation 100, and a casing 104 lining the wellbore 102. A production string 110 with a wellscreen 116 disposed at a lower end thereof provides a path for fluid to pass through the production string 110 to the surface of the well 122 for further processing. Perforations 106 are also formed in the casing 104 to allow production material to flow from the formation 100 into the wellbore 102.

Disposed between the production string 110 and the wellscreen 116 is a cross-over tool 112. The cross-over tool 112 comprises a central pipe 111 and a chute 118 extending outward from the central pipe 111 and into an annular area 114. Gravel 120 is dispensed in a slurry form from the surface of the well 122 and exits at the chute 118 to fill the annulus 114. A wash pipe 108 (shown with dotted lines in FIG. 1) is contained within the production string 110 and serves as a conduit for extracting the liquid from the slurry so that only the gravel 120 remains in the annulus 114.

Gravel packing is not a precise process. For example, some portion of the wellscreen may not always receive adequate gravel packing therearound and may be left exposed. The suction created by the wash pipe as it urges liquid out of the wellbore may compress the gravel, leaving the upper portion of the wellscreen exposed. The gravel may also settle over time, leaving the wellscreen partially exposed. The exposed area of the wellscreen is then subjected to high velocity production fluid containing solid materials. Such solid materials are normally trapped by the gravel thereby prevent damage the wellscreen. However, the exposed portion of the wellscreen provides a path for the solid materials to impact the wellscreen directly, causing premature erosion, corrosion and compromising the structural integrity of the wellscreen.

In response to the erosion and corrosion problems, protective coatings have been applied to the wellscreen.

However, the conventional techniques typically require the coating to be sprayed onto wellscreen, which can waste the coating materials and may not adequately cover the entire screen. In addition, the spraying technique does not apply the coating evenly on the wellscreen leaving parts of the wellscreen at least partially exposed to erosion and corrosion. Further, the conventional techniques coat only the screen portion of the wellscreen, leaving the other components, like the interior base pipe, susceptible to erosion.

Therefore, there is a need for a wellscreen that is more erosion and corrosion resistant to impact by fluids containing solid materials. There is also a need for a method of protecting wellscreens from premature erosion and corrosion that can be applied efficiently and evenly and to all parts of the wellscreen for maximum protection.

SUMMARY OF THE INVENTION

The present invention generally provides an apparatus and method for preventing erosion and corrosion of wellbore components through the use of a coating applied to the component. In one aspect, the coating includes a metal-based coating and is preferably nickel and phosphorous. The coating may also be an organic-based coating such as phenolic resin containing ceramic or cermet. The coating may be applied to all parts of the wellscreen including the base pipe. In another aspect, a method for fabricating an erosion resistant wellbore component comprises providing the wellbore component and treating the wellbore component with erosion resistant materials. The treating step is conducted by plating the wellbore component, preferably by electroless plating. The treating step may further comprise heat treatment of the wellbore component subsequent to plating.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures.

DETAILED DESCRIPTION OF THE PREFERRED EMBODIMENT

Figure 1:
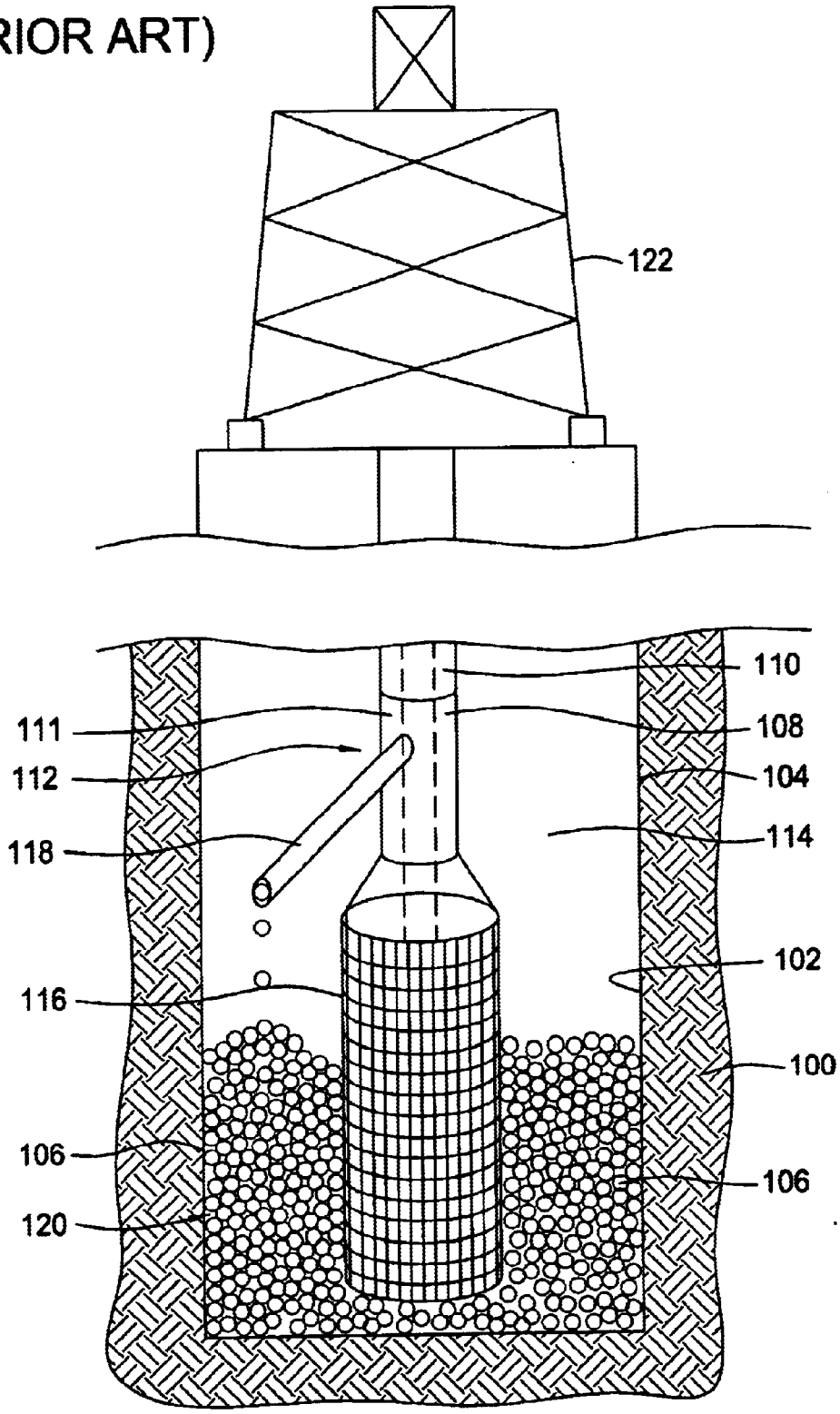
FIG. 1 (PRIOR ART)
FIG. 1 is a cross-sectional view of a wellbore with a wellscreen at the bottom thereof and a gravel pack therearound.
Figure 2:
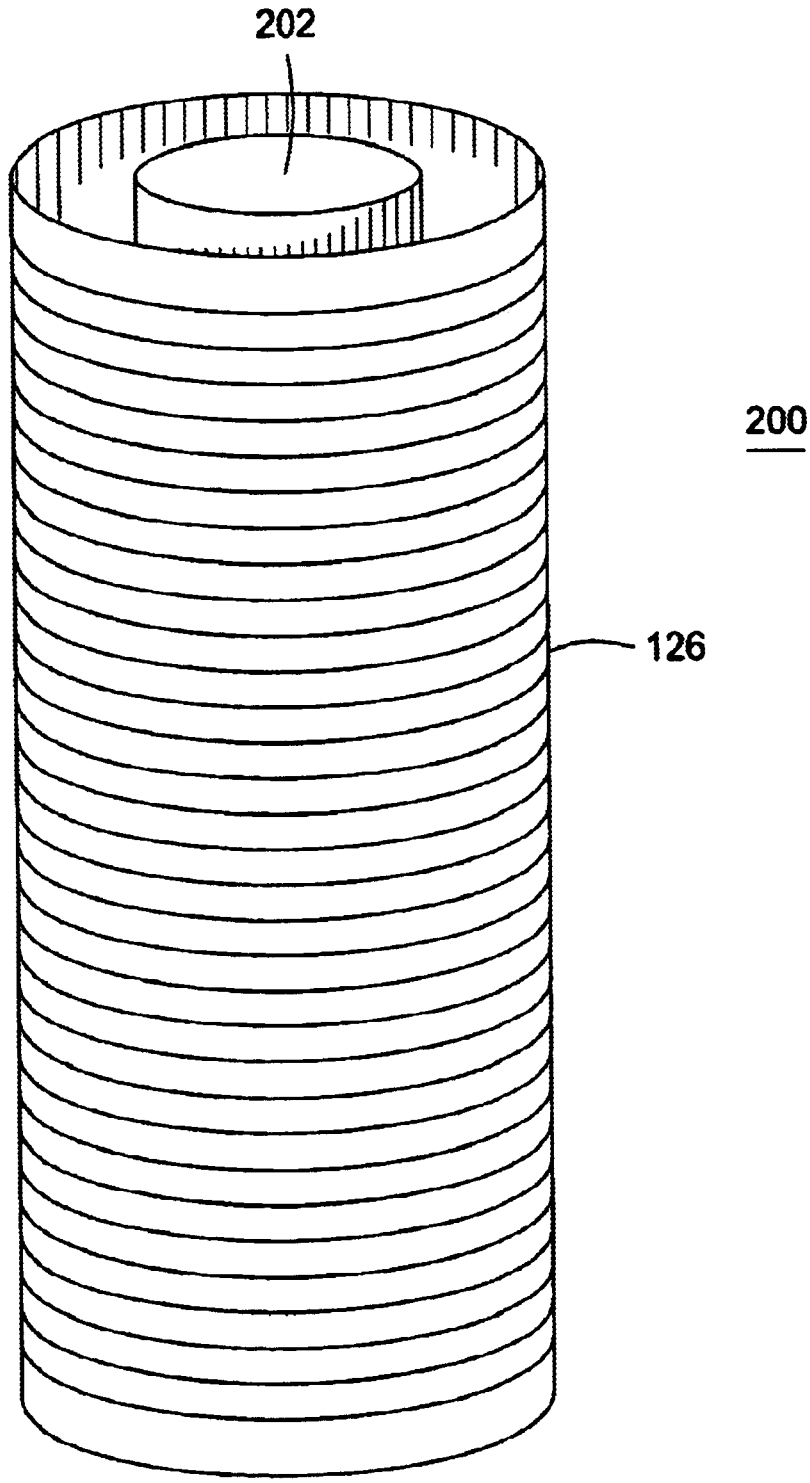
FIG. 2 is a side view of a wellscreen of the present invention.

FIG. 2 is a side view of a wellscreen of the present invention. The apparatus includes a screen 126 disposed around a base pipe 202. The base pipe is typically perforated and the screen is typically fabricated of some woven material permitting filtered fluid to pass therethrough. A connection means, like threads are formed at an upper end of the wellscreen to facilitate connection to a tubular string (not shown). Preferably, both the screen 126 and base pipe 202 include a coating applied thereto. The coating promotes greater durability and longevity by making the wellscreen more erosive and corrosive resistant. The coating is preferably metal-based and may include a high phosphorous nickel content. An organic or partly organic coating material such as phenolic resin with a cermet or ceramic addition may also be utilized. Other types of material that are erosion and corrosion resistant are also adequate coating candidates.

Figure 3:
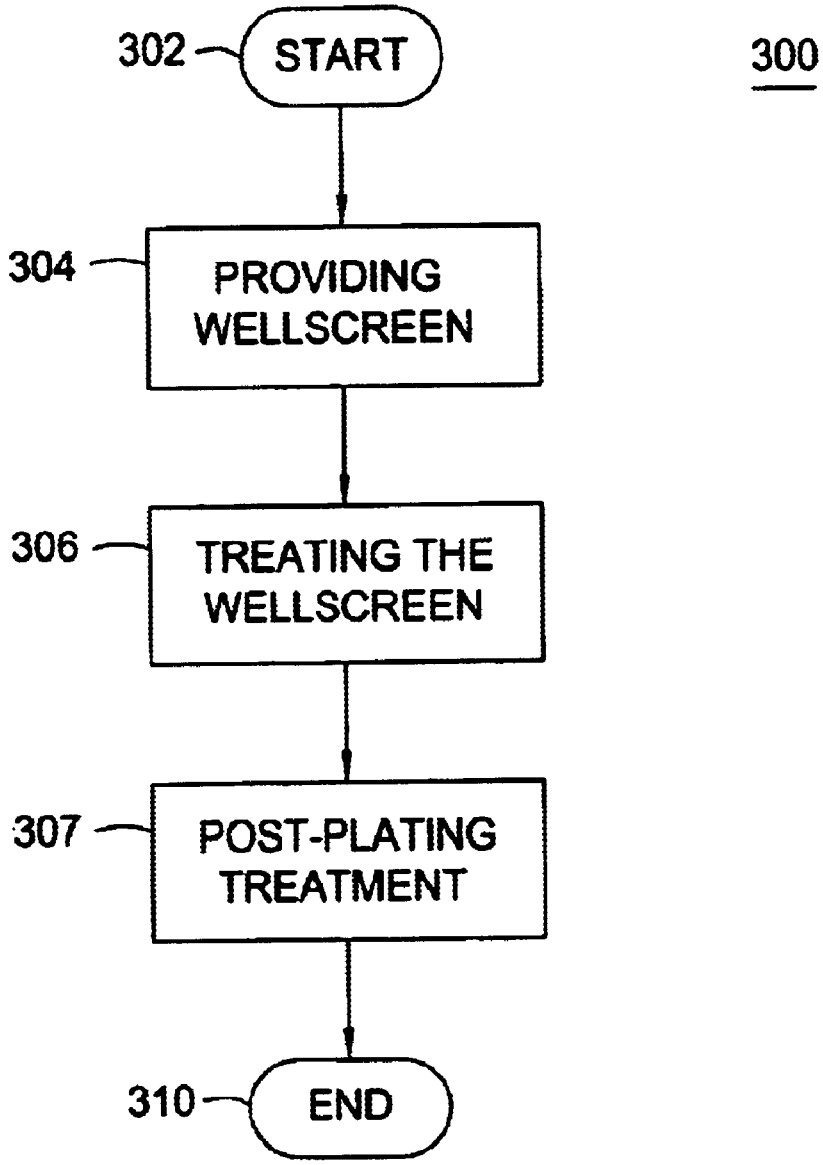
FIG. 3 depicts a series of steps for preventing erosion of a wellbore component and in particular, of a wellscreen.

FIG. 3 depicts a method 300 for preventing erosion of a wellscreen. Specifically, the method starts at step 302 and proceeds to step 304 wherein a wellscreen is provided. The wellscreen is a typical wellscreen known to those skilled in the art such as wellscreen 126 discussed above. At step 306, the wellscreen is treated by applying a coating material that increases the corrosion and erosion resistance of the wellscreen by electroless plating. Electroless plating is a process whereby the equipment to be plated is immersed in a bath solution. Electroless plating results in a relatively uniform coating of all parts of the wellscreen. In a preferred embodiment of the invention, the coating material is from about 85% to 95% nickel, preferably about 90%, and from about 5% to 15% phosphorous, preferably about 10%. Subsequently, a post-plating treatment 307 is conducted in which heat is applied to the plated wellscreen. In a preferred embodiment, heat is applied at a temperature about 350° F. to the plated wellscreen for a period of approximately three (3) hours. The method of preventing erosion of a wellscreen ends at step 310. The treatment steps 306, 307 can be repeated until a predetermined amount of coating has been applied to the wellscreen. The forgoing method provides a more erosion resistant wellscreen that suffers less mass loss when used in a wellbore. In this manner, the improved wellscreen can operate with greater longevity in the wellbore and have greater resistance to erosion caused by solid material entering a wellbore.

Tests were conducted using the method above, where coating material was applied to 304 stainless steel because of its similarity to materials used in wellscreens. A typical test result is shown in Table 1. The "slurry abrasive response" test was conducted on specimen Wp made of 304 stainless steel coated by electroless high phosphorous nickel plating according to one aspect of the invention. A control specimen Wc made of untreated 304 stainless steel was also used in the testing. The original mass of Wp was 24.43 g (gram) and the original mass of Wc was 23.35 g. The specimens were subjected to slurry abrasion similar to what must be expected during gravel packing. The slurry utilized included distilled water mixed with a standard 50–70 test sand. Measurements of the loss of mass in milligrams (mg) of the specimens were taken at two (2) hour intervals for up to six (6) hours. From Table 1 below, it is clear that coated specimen Wp experienced significantly less mass loss (246.4 mg) than the untreated specimen Wc (489.0 mg). The data below illustrates that by using the apparatus and methods described herein, the wellbore components are better protected from erosion.

TABLE 1

Test Results for Slurry Abrasive Response Showing Loss in mg During 2 Hour Periods.

| Hours | Specimen Wp | Specimen Wc |
|---|---|---|
| Initial Mass loss | 0.0 mg | 0.0 mg |
| After 2 Hours | 109.4 mg | 232.0 mg |
| After 4 Hours | 86.1 mg | 187.2 mg |
| After 6 Hours | 50.9 mg | 69.8 mg |
| Total | 246.4 mg | 489.0 mg |

While the foregoing is directed to the preferred embodiment of the present invention, other and further embodiments of the invention may be devised without departing from the basic scope thereof, and the scope thereof is determined by the claims that follow.

What is claimed is:

1. An apparatus for preventing erosion of wellbore components comprising:

a wellscreen assembly having a perforated inner tube and at least one screen disposed therearound;

the screen being fluid-porous; and a coating disposed on the wellscreen assembly wherein the coating is a metal-based coating including nickel in a concentration of about 85% to 95%.

2. The apparatus of claim 1, wherein the metal-based coating includes phosphorous.

3. The apparatus of claim 2, where in the phosphorous concentration of the coating is from about 5% to about 15%.

4. The apparatus of any of the above claims, wherein the screen is fabricated of a woven material.

* * * * *